US009683462B2

(12) United States Patent
Geveci

(10) Patent No.: US 9,683,462 B2
(45) Date of Patent: Jun. 20, 2017

(54) COOLING FLUID FLOW CONTROL SYSTEM FOR STEAM TURBINE SYSTEM AND PROGRAM PRODUCT

(71) Applicant: General Electric Company, Schenectady, NY (US)

(72) Inventor: Mert Geveci, Delmar, NY (US)

(73) Assignee: General Electric Company, Schenectady, NY (US)

( * ) Notice: Subject to any disclaimer, the term of this patent is extended or adjusted under 35 U.S.C. 154(b) by 726 days.

(21) Appl. No.: 14/101,709

(22) Filed: Dec. 10, 2013

(65) Prior Publication Data

US 2015/0159514 A1 Jun. 11, 2015

(51) Int. Cl.
*F01D 17/08* (2006.01)
*F01K 13/02* (2006.01)

(52) U.S. Cl.
CPC ..... *F01K 13/025* (2013.01); *F01D 17/085* (2013.01)

(58) Field of Classification Search
CPC ..... F01K 13/025; F01D 17/08; F01D 17/085; F01D 17/20; F05D 2270/303; F05D 2270/44
See application file for complete search history.

(56) References Cited

U.S. PATENT DOCUMENTS 4,242,041 A 12/1980 Silvestri, Jr.
2012/0031581 A1* 2/2012 Chillar ..... F01D 17/085 165/11.1
2012/0058013 A1 3/2012 Swanson et al.
2012/0073289 A1 3/2012 Ast et al.
(Continued)

FOREIGN PATENT DOCUMENTS

CN 1058449 C 11/2000
CN 101372900 A 2/2009
(Continued)

OTHER PUBLICATIONS

European Search Report and Written Opinion issued in connection with corresponding EP Application No. 14196181.3-1610 dated Jul. 8, 2015.
(Continued)

*Primary Examiner* — Gregory Anderson
*Assistant Examiner* — Danielle M Christensen
(74) *Attorney, Agent, or Firm* — Ernest G. Cusick; Hoffman Warnick LLC

(57) ABSTRACT

A cooling fluid flow control system for a turbine section of a steam turbine system and a related program product are provided. In one embodiment, a system includes at least one computing device operably connected to a cooling system. The computing device may be configured to control a flow rate of cooling fluid supplied to a steam turbine system by the cooling system by performing actions including modeling a sensitivity of a wheel space temperature to a change in the flow rate in the form of a piecewise linear relationship, the piecewise linear relationship including a flooded flow rate above which the wheel space temperature becomes insensitive to increased flow rate. The computing device also periodically modifies the flow rate of the cooling fluid supplied to the wheel space of the turbine section to approximate a minimum flooded flow rate based on the measured flow rate and the modeling.

19 Claims, 5 Drawing Sheets

(56) References Cited

U.S. PATENT DOCUMENTS

| | | | | |
|---|---|---|---|---|
| 2012/0111020 | A1* | 5/2012 | Bozzi | F02C 7/18 60/782 |
| 2013/0323009 | A1 | 12/2013 | Bowen et al. | |

FOREIGN PATENT DOCUMENTS

| | | | |
|---|---|---|---|
| CN | 101713337 | B | 9/2009 |
| CN | 101701533 | B | 10/2009 |
| WO | 2013016438 | A3 | 7/2013 |

OTHER PUBLICATIONS

CN Office Action dated Feb. 23, 2017; Application No. 201410751147.4; pp. 5.

* cited by examiner

COOLING FLUID FLOW CONTROL SYSTEM FOR STEAM TURBINE SYSTEM AND PROGRAM PRODUCT

BACKGROUND OF THE INVENTION

1. Technical Field

The disclosure is related generally to steam turbine systems. More particularly, the disclosure is related to a cooling fluid flow control system for a high pressure turbine section of a steam turbine system and a related program product.

2. Related Art

Conventional steam turbine systems are frequently utilized to generate power for, e.g., electric generators. More specifically, a working fluid, such as steam, is conventionally forced across sets of steam turbine blades, which are coupled to the rotor of the steam turbine system. The force of the working fluid on the blades causes those blades (and the coupled body of the rotor) to rotate. In many cases, the rotor body is coupled to the drive shaft of a dynamoelectric machine such as an electric generator. In this sense, initiating rotation of the steam turbine system rotor can initiate rotation of the drive shaft in the electric generator, and cause that generator to generate an electrical current (associated with power output).

The amount of power generated by the steam turbine during operation may be dependent upon, at least in part, the temperature of the working fluid (e.g., steam) flowing through the system. That is, the higher the temperature of the working fluid flowing through the steam turbine system, the greater the amount of power generated by the steam turbine system. However, as the temperature of the working fluid increases and the internal temperature of the steam turbine system increases, the risk of undesirable effects within the steam turbine system also increases. More specifically, when the temperature of the working fluid surpasses a predetermined desirable temperature, the risk of undesirable defects, such as deformation or "creep" of the internal components, within the steam turbine system significantly increases.

In order to provide steam turbine systems that operate at elevated pressure and temperature states (e.g., at supercritical or even ultra-supercritical conditions) and prevent the above-described negative impacts, new systems are now being provided with a cooling system to provide a cooling fluid to the wheel space of the high pressure turbine section of the steam turbine system during operation. More specifically, the cooling system may provide cooling fluid to, for example, the wheel space of a high pressure (HP) turbine section and the region of the HP turbine section surrounding the rotor during operation. The cooling fluid of the cooling system may substantially regulate the internal temperature of the wheel space of the steam turbine system from reaching an undesirable temperature. This regulation of the internal temperature may ultimately prevent the steam turbine system and/or the internal components of the steam turbine system from being negatively impacted by high temperature steam.

Cooling systems have been developed to regulate the internal temperatures of cooling fluid. However, the HP turbine section temperature can also be controlled by the flow rate of the cooling fluid provided to the HP turbine section based on the operational characteristics of the system. However, because the operational characteristics vary over time (e.g., internal temperature fluctuation, clearance changes due to wear, varying loads, etc.), the new cooling systems may provide cooling fluid which may over-cool or under-cool the steam turbine system due to an undesirable high flow rate of the cooling fluid. In this instance, the new cooling systems may also temporarily cause a decrease in efficiency of the steam turbine system and ultimately the amount of power generated by the system.

BRIEF DESCRIPTION OF THE INVENTION

A cooling fluid flow control system for a turbine section of a steam turbine system and a related program product are provided. In one embodiment, a system includes at least one computing device operably connected to a cooling system. The computing device may be configured to control a flow rate of cooling fluid supplied to a steam turbine system by the cooling system by performing actions including modeling a sensitivity of a wheel space temperature to a change in the flow rate in the form of a piecewise linear relationship, the piecewise linear relationship including a flooded flow rate above which the wheel space temperature becomes insensitive to increased flow rate. The computing device also periodically modifies the flow rate of the cooling fluid supplied to the wheel space of the turbine section to approximate a minimum flooded flow rate based on the measured flow rate and the modeling.

A first aspect of the invention includes a system comprising: at least one computing device operably connected to a cooling system for a turbine section of a steam turbine system for controlling a flow rate of cooling fluid supplied to a wheel space of the turbine section by the cooling system, the at least one computing device performing actions including: modeling a sensitivity of a wheel space temperature to a change in the flow rate in the form of a piecewise linear relationship, the piecewise linear relationship including a flooded flow rate above which the wheel space temperature becomes insensitive to increased flow rate; receive a measurement of the flow rate; and periodically modifying the flow rate of the cooling fluid supplied to the wheel space of the turbine section to approximate a minimum flooded flow rate based on the measured flow rate and the modeling.

A second aspect of the invention includes a program product stored on a computer readable storage medium for controlling a flow rate of cooling fluid supplied to a wheel space of a turbine section of a steam turbine system by a cooling system, the non-transitory computer readable storage medium comprising program code for causing the computer system to: model a sensitivity of a wheel space temperature to a change in the flow rate in the form of a piecewise linear relationship, the piecewise linear relationship including a flooded flow rate above which the wheel space temperature becomes insensitive to increased flow rate; receive a measurement of the flow rate; and periodically modify the flow rate of the cooling fluid supplied to the wheel space of the turbine section to approximate a minimum flooded flow rate based on the measured flow rate and the modeling.

A third aspect of the invention includes a steam turbine system cooling system comprising: at least one flow valve for controlling a cooling fluid flow to a wheel space of a turbine section from a source of cooling fluid; and at least one computing device operably connected to the at least one flow valve for controlling the flow rate of cooling fluid supplied to the wheel space, the at least one computing device performing actions including: modeling a sensitivity of a wheel space temperature to a change in the flow rate in the form of a piecewise linear relationship, the piecewise linear relationship including a flooded flow rate above which the wheel space temperature becomes insensitive to increased flow rate; receiving a measurement of the flow rate; and periodically modifying the flow rate of the cooling fluid supplied to the wheel space of the turbine section to approximate a minimum flooded flow rate based on the measured flow rate and the modeling.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
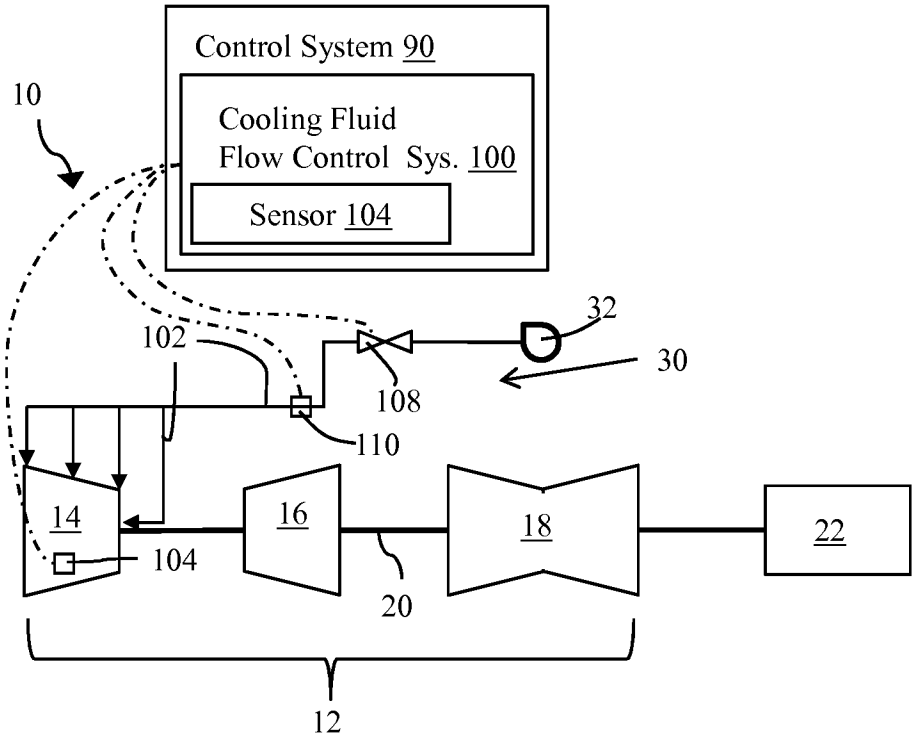
FIG. 1 shows a schematic view of a steam turbine system including a cooling fluid flow control system and a steam turbine system cooling system according to embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As discussed herein, aspects of the invention relate generally to steam turbine systems. More particularly, as discussed herein, aspects of the invention relate to a cooling fluid flow control system for a turbine section of a steam turbine system and a related program product.

Turning to FIG. 1, a schematic depiction of a steam turbine system 10 is shown according to embodiments of the invention. Steam turbine system 10, as shown in FIG. 1, may include any variety of steam turbine system using a new form of a wheel space cooling system, as described herein. In one example, steam turbine system 10 may include an ultra-supercritical steam turbine system, e.g., with a high pressure (HP) steam turbine section 14 that operates ultra-supercritical steam state greater than 22 MegaPascals (MPa). As shown in FIG. 1, steam turbine system 10 may include a steam turbine component 12, including a high-pressure (HP) turbine section 14, an intermediate-pressure (IP) turbine section 16 and a low-pressure (LP) turbine section 18. Other conventional turbine sections (not shown) may also be present. Steam turbine component 12, and specifically the various sections (e.g., HP turbine section 14, etc.) may be coupled to a rotor 20 of steam turbine system 10. Rotor 20 may also be coupled to a generator 22 for generating electricity during operation of steam turbine system 10. That is, during operation of steam turbine system 10, a working fluid (e.g., steam) may flow through the various sections of steam turbine component 12 to contact a plurality of buckets and stator nozzles (FIG. 2) of each section, and drive rotor 20, which may ultimately generate power within generator 22 coupled to rotor 20.

As shown in FIG. 1, steam turbine system 10 may also include a cooling system 30 that is controlled by a cooling fluid flow control system 100. Cooling fluid flow control system 100 may be part of an overall control system 90, described elsewhere herein. More specifically, as shown in FIG. 1, cooling system 30 may include a cooling fluid source 32 that supplies cooling fluid to HP turbine section 14 via plurality of cooling fluid conduits 102. As shown in FIG. 1, fluid conduits 102 may provide the cooling fluid to HP turbine section 14 by flowing the cooling fluid through each of the housings 23 (FIG. 2) of the various sections of HP turbine section 14. Additionally, as shown in FIG. 1, cooling fluid conduits 102 may provide the cooling fluid to HP turbine section 14 along rotor 20 for substantially cooling the wheel space area (e.g., FIG. 2), as discussed herein. During operation of steam turbine system 10, cooling fluid flow control system 100 may control flow of a cooling fluid to the various sections of HP turbine section 14 via cooling fluid conduits 102 of cooling system 92 to substantially prevent HP turbine section 14 of steam turbine system 10 from having an undesirable internal temperature. As discussed herein, the undesirable internal temperature may result in negative effects on the components of steam turbine system 10 (e.g., creep-effects). Although the teachings of the invention relative to cooling fluid flow control system 100 are indicated as being applied solely to HP turbine section 14 (i.e., because it is the turbine section of turbine component 12 that receives the hottest steam), the teachings of the invention may be applied to other turbine sections or other industrial components requiring cooling fluid flow control. For example, the teachings of the invention may be applied to reheat steam turbine section of steam turbine system 10. Consequently, the term "turbine section" (although referencing HP turbine section 14 in the drawings), as used hereafter and in the claims, is meant to apply to any turbine section within steam turbine system 10 that may find advantage with a cooling system controlled by cooling fluid flow control system 100.

Figure 2:
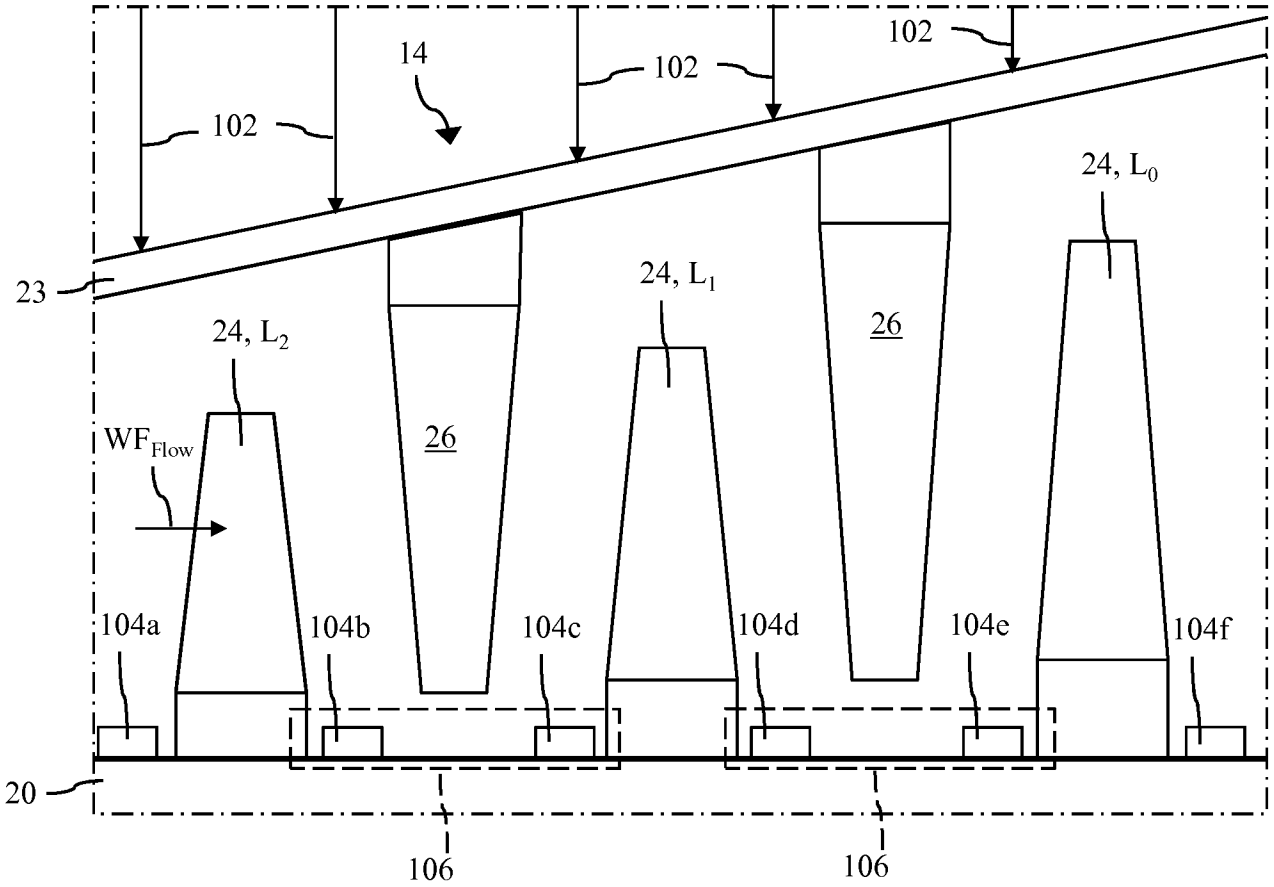
FIG. 2 shows an enlarged portion of a high pressure turbine section as shown in FIG. 1 including various sensors, according to embodiments of the invention.

As shown in FIGS. 1 and 2, cooling fluid flow control system 100 (i.e., at least one computer device 204 (FIG. 3)) may be operably connected to at least one temperature sensor 104 positioned to measure an (actual) wheel space temperature of turbine section 14, as discussed herein. For example, FIG. 2 shows an enlarged portion of Turbine section 14 of steam turbine component 12 as shown in FIG. 1 including a plurality of temperature sensors 104*a-f* of cooling fluid flow control system 100, according to embodiments of the invention. (Note, the arrangement of turbine section 14 in FIG. 2 is flipped relative to FIG. 1—no difference in structure is meant to be indicated by this flip in drawing layout). As shown in FIG. 2, a plurality of sensors 104*a-f* may be positioned within wheel space 106 of turbine section 14 of steam turbine component 12, and may be coupled to rotor 20 of steam turbine system 10. More specifically, as shown in FIG. 2, each of the plurality of temperature sensors 104*a-f* may be positioned within wheel space 106 and may be positioned between distinct stages ($L_{0-2}$) of buckets 24 and/or stator nozzles 26 of turbine section 14 of steam turbine component 12. Each distinct stage ($L_{0-2}$) of buckets 24 may include two temperature sensors 104 positioned both upstream and downstream of a working fluid flow ($WF_{flow}$) for each bucket 24 of the LP turbine section 18. For example, as shown in FIG. 2, second stage bucket 24, $L_2$ may include temperature sensor 104*a* positioned upstream of second stage bucket 24, $L_2$ for determining an upstream actual wheel space temperature for second stage bucket 24, $L_2$, and temperature sensor 104*b* positioned downstream of second stage bucket 24, $L_2$ for determining a downstream actual wheel space temperature for second stage bucket 24, $L_2$. As discussed herein, the actual wheel space temperature (e.g., upstream, downstream) may be utilized by cooling fluid flow control system 100 to substantially prevent the negative effects (e.g., creep) experienced by steam turbine system 10 during operation. Temperature sensor 104 may be configured as any conventional device for determining an actual wheel space temperature of turbine section 14 including, but not limited to, thermometer, thermocouples, thermistors, pyrometer, infrared sensor, etc. As discussed herein, temperature sensor 104 may continuously measure and provide the actual wheel space temperature of turbine section 14 of steam turbine system 10 to cooling fluid flow control system 100 during operation of steam turbine system 10. The "wheel space temperature" as used herein may be a combination of the actual, measured wheel space temperatures, or each measured wheel space temperature may be used individually.

Briefly returning to FIG. 1, cooling fluid flow control system 100 may also include a flow valve 108 positioned within cooling fluid conduit 102. More specifically, as shown in FIG. 1, flow valve 108 may be positioned within cooling fluid conduit 102 and may be operably connected (e.g., via wireless, hardwire, or other conventional means) to cooling fluid flow control system 100. Flow valve 108 of cooling fluid flow control system 100 may be configured to increase or decrease the amount or flow rate of the cooling fluid supplied to turbine section 14 by/from cooling fluid source 32 during operation, as discussed herein. As understood in the art, while a single flow valve 108 and a single cooling fluid source 32 have been illustrated, flow valve 108 (hereinafter "flow valve(s) 108") is typically a combination of valves that may control the flow rate of the cooling fluid from one or more cooling fluid sources 32. Flow valve(s) 108 may be coupled to any now known or later developed source(s) of cooling fluid 32. For example, flow valve(s) 108 may include two extraction valves configured to create cooling fluid flow from a cooled steam flow originating from a boiler (not shown), and perhaps an isolation valve configured to isolate turbine section 14 from cooling fluid during startup and other conditions when cooling flow is not required. Flow valve(s) 108 may take any form, including, but not limited to: a hydraulic valve, a pneumatic valve, a solenoid valve, or a motorized valve. Any now known or later developed controller for controlling a temperature of the cooling fluid, e.g., by selectively controlling the volume of different temperature steam flows used to create the cooling fluid flow, may also be employed with cooling system 100 along with cooling fluid flow control system 100.

Figure 3:
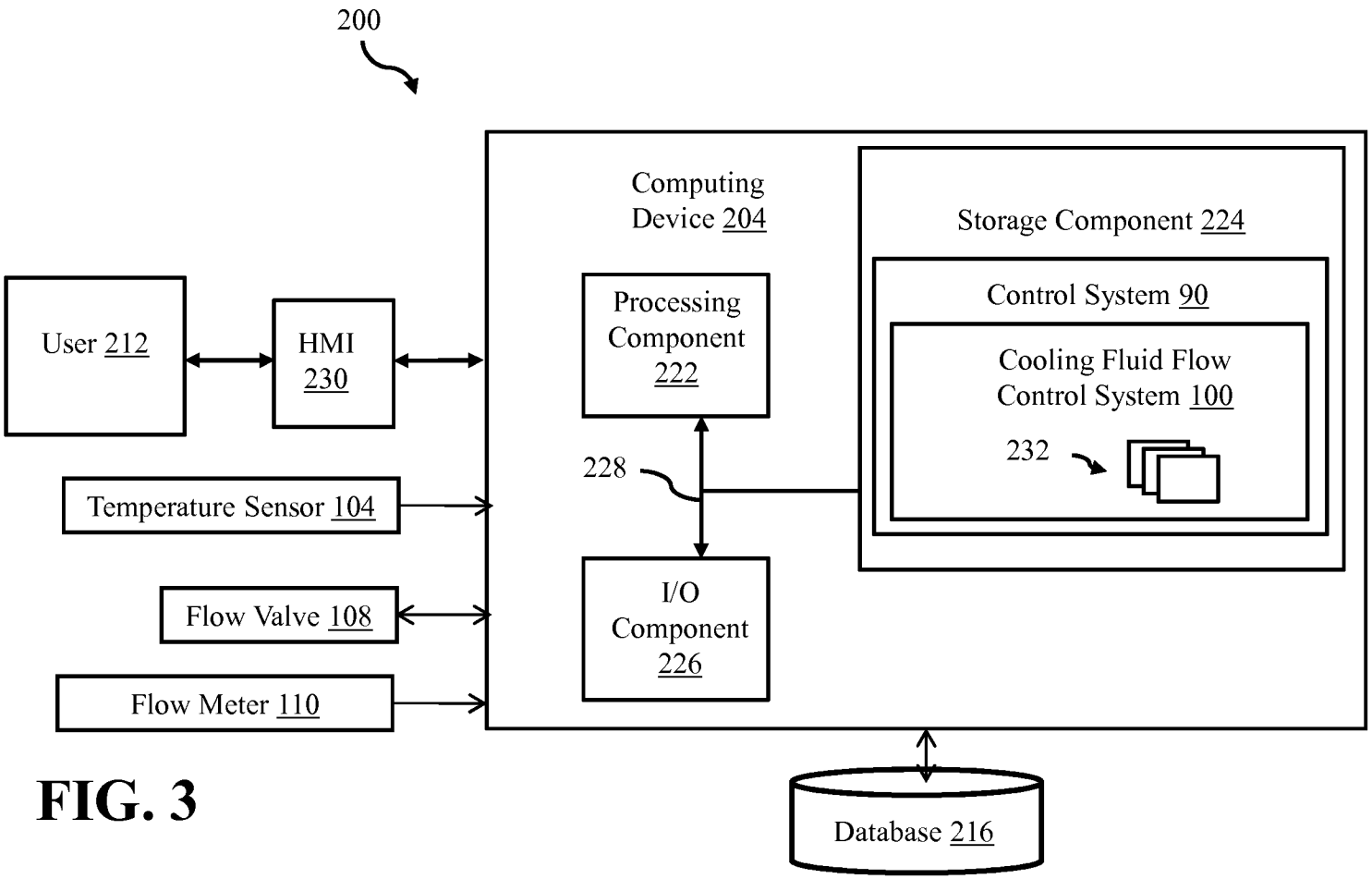
FIG. 3 shows an illustrative environment including a cooling fluid flow control system according to embodiments of the invention.

Cooling fluid flow control system 100 may also include a flow meter 110 positioned to measure the flow rate, e.g., at an appropriate location within cooling fluid conduit 102, and operably connected to the at least one computing device 204 (FIG. 3). More specifically, as shown in FIG. 1, flow meter 110 may be positioned within cooling fluid conduit 102 and may be operably connected (e.g., via wireless, hardwire, or other conventional means) to cooling fluid flow control system 100. Although one flow meter 110 is illustrated, it is understood that more than one flow meter may be employed, if necessary, e.g., where overall flow rate cannot be measured within a single cooling fluid conduit 102.

Control system 90 and cooling fluid flow control system 100 may be part of any now known or later developed steam turbine control system architecture, and may employ known control methodology, e.g., cascade loops, feedforward, feedback, auto-tuning, etc. As overall operation of such control systems is known in the art, no further detail other than that particular to control system 100 will be provided.

Turning to FIG. 3, an illustrative environment 200 including cooling fluid flow control system 100 for steam turbine system 10 (FIG. 1) according to embodiments of the invention is provided. To this extent, the environment 200 includes a computing device 204 that can perform a process described herein in order to provide a cooling fluid to turbine section 14 during operation. In particular, the computing device 204 is shown as including control system 90, which makes computing device 204 operable to determine and control any now known or later developed operational characteristics of steam turbine system 10. Although cooling fluid flow control system 100 is indicated as part of control system 90, it is understood that it may be a standalone system. In any event, cooling fluid control system 100 controls a flow rate of the cooling fluid to turbine section 14 (FIG. 1) by performing any/all of the processes described herein and implementing any/all of the embodiments described herein.

In an embodiment, as shown in FIG. 3, cooling fluid flow control system 100 may be operably connected to computing device 204. More specifically, as shown in FIG. 3, cooling fluid flow control system 100, at least one temperature sensor 104 and flow meter 110 may be operably connected (e.g., via wireless, hardwire, or other conventional means) to computing device 204, such that computing device 204 may control the flow rate of the cooling fluid supplied to turbine section 14. Additionally, as shown in FIG. 3 and discussed herein, computing device 204 may be operably connected to flow valve(s) 108 of cooling fluid flow control system 100, such that computing device 204 adjust the position of flow valve(s) 108 to control the flow rate of the cooling fluid supplied to turbine section 14. Computing device 204 may also include a database 216, which may include any required data for operation of cooling fluid flow control system 100 such as modeling data of wheel space temperature versus cooling fluid flow.

The computing device 204 is shown including a processing component 222 (e.g., one or more processors), a storage component 224 (e.g., a storage hierarchy), an input/output (I/O) component 226 (e.g., one or more I/O interfaces and/or devices), and a communications pathway 228. In general, the processing component 222 executes program code, such as control system 90 and/or cooling fluid control system 100, which is at least partially fixed in the storage component 224. While executing program code, the processing component 222 can process data, which can result in reading and/or writing transformed data from/to the storage component 224 and/or the I/O component 226 for further processing. The pathway 228 provides a communications link between each of the components in the computing device 204. The I/O component 226 can comprise one or more human I/O devices, which enable a human user 212 (e.g., steam turbine system operator) to interact with the computing device 204 and/or one or more communications devices to enable a system user 212 to communicate with the computing device 204 using any type of communications link. In some embodiments, user 212 (e.g., steam turbine system operator) can interact with a human-machine interface (HMI) 230, which allows user 212 to communicate with control system 90 and/or cooling fluid flow control system 100 of computing device 204. Human-machine interface 230 can include: an interactive touch screen, a graphical user display or any other conventional human-machine interface known in the art. To this extent, the control system 90 can manage a set of interfaces (e.g., graphical user interface(s), application program interface, etc.) that enable human and/or system users 212 to interact with system(s) 90, 100. Further, system(s) 90, 100 can manage (e.g., store, retrieve, create, manipulate, organize, present, etc.) data in the storage component 224, such as wheel space temperatures, cooling fluid flow rates, etc., using any solution. More specifically, control system 90 and/or cooling fluid flow control system 100 can store data in database 216.

In any event, computing device 204 can comprise one or more general purpose computing articles of manufacture (e.g., computing devices) capable of executing program code, such as cooling fluid flow control system 100, installed thereon. As used herein, it is understood that "program code" means any collection of instructions, in any language, code or notation, that cause a computing device having an information processing capability to perform a particular function either directly or after any combination of the following: (a) conversion to another language, code or notation; (b) reproduction in a different material form; and/or (c) decompression. To this extent, the cooling fluid flow control system 100 can be embodied as any combination of system software and/or application software.

Further, cooling fluid flow control system 100 can be implemented using a set of modules 232. In this case, a module 232 can enable the computing device 204 to perform a set of tasks used by cooling fluid flow control system 100, and can be separately developed and/or implemented apart from other portions of cooling fluid flow control system 100. As used herein, the term "component" means any configuration of hardware, with or without software, which implements the functionality described in conjunction therewith using any solution, while the term "module" means program code that enables the computing device 204 to implement the functionality described in conjunction therewith using any solution. When fixed in a storage component 224 of a computing device 204 that includes a processing component 222, a module is a substantial portion of a component that implements the functionality. Regardless, it is understood that two or more components, modules, and/or systems may share some/all of their respective hardware and/or software. Further, it is understood that some of the functionality discussed herein may not be implemented or additional functionality may be included as part of the computing device 204.

When computing device 204 comprises multiple computing devices, each computing device may have only a portion of control system 90 and/or cooling fluid flow control system 100 fixed thereon (e.g., one or more modules 232). However, it is understood that the computing device 204 and control system 90 and/or cooling fluid flow control system 100 are only representative of various possible equivalent computer systems that may perform a process described herein. To this extent, in other embodiments, the functionality provided by the computing device 204 and control system 90 and/or cooling fluid flow control system 100 can be at least partially implemented by one or more computing devices that include any combination of general and/or specific purpose hardware with or without program code. In each embodiment, the hardware and program code, if included, can be created using standard engineering and programming techniques, respectively.

Regardless, when computing device 204 includes multiple computing devices, the computing devices can communicate over any type of communications link. Further, while performing a process described herein, computing device 204 can communicate with one or more other computer systems using any type of communications link. In either case, the communications link can comprise any combination of various types of wired and/or wireless links; comprise any combination of one or more types of networks; and/or utilize any combination of various types of transmission techniques and protocols.

Computing device 204 can obtain or provide data using any solution. For example, the computing device 204 can obtain and/or retrieve modeling data from one or more data stores, receive modeling data from another system, send modeling data to another system, etc.

While shown and described herein as a system for controlling a flow rate of cooling fluid supplied to turbine section 14, by cooling fluid flow control system 100, it is understood that aspects of the invention further provide various alternative embodiments. For example, in one embodiment, the invention provides a computer program fixed in at least one computer-readable medium, which when executed, enables a computer system to control a flow rate of cooling fluid supplied to turbine section 14 by cooling fluid flow control system 100. To this extent, the computer-readable medium includes program code, such as cooling fluid flow control system 100 (FIG. 3), which implements some or all of the processes and/or embodiments described herein. It is understood that the term "computer-readable storage medium" comprises one or more of any type of non-transitory or tangible medium of expression, now known or later developed, from which a copy of the program code can be perceived, reproduced, or otherwise communicated by a computing device. For example, the computer-readable storage medium can comprise: one or more portable storage articles of manufacture; one or more memory/storage components of a computing device; paper; etc.

In another embodiment, the invention provides a system for controlling a flow rate of cooling fluid supplied to turbine section 14 by cooling fluid flow control system 100. In this case, a computer system, such as the computing device 204, can be obtained (e.g., created, maintained, made available, etc.) and one or more components for performing a process described herein can be obtained (e.g., created, purchased, used, modified, etc.) and deployed to the computer system. To this extent, the deployment can comprise one or more of: (1) installing program code on a computing device; (2) adding one or more computing and/or I/O devices to the computer system; (3) incorporating and/or modifying the computer system to enable it to perform a process described herein; etc.

Figure 4:
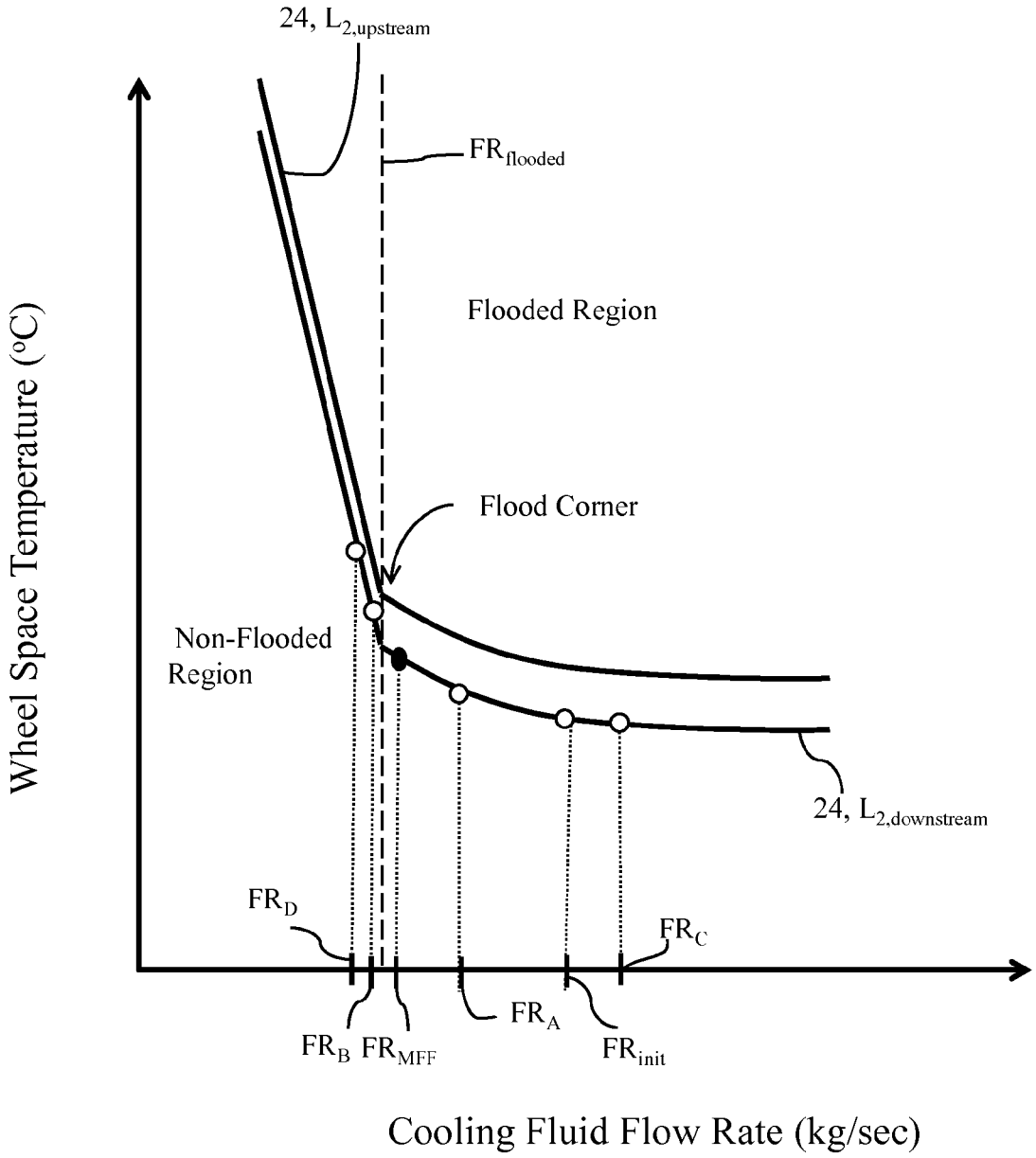
FIG. 4 shows a graph illustrating a piecewise linear relationship of wheel space temperature to cooling fluid flow rate as modeled according to embodiments of the invention.

Turning to FIG. 4, an illustrative embodiment of a piecewise linear relationship between cooling fluid flow rate (kg/hr) versus wheel space temperature (° C.) of the steam within turbine section 14 is shown in a graph. The term "piecewise" indicates that there are a pair of linked linear sub-relationships. The operational characteristics of turbine section 14 that leads to this relationship can be based upon a large number of factors, including but not limited to: a predetermined stage(s) of turbine section 14 at which wheel space temperature is evaluated, a load of steam turbine system 10, a length of usage of turbine section 14 and, more specifically, a clearance between parts thereof created by wear over time. In FIG. 4, a relationship is shown for both an upstream and downstream wheel space temperature for a second stage bucket 24, $L_2$ (FIG. 2), as determined by cooling fluid flow control system 100. The relationship for the upstream position is the higher of the lines on the graph. As shown in FIG. 4, as cooling fluid flow rate increases (away from the wheel space temperature axis), wheel space temperature declines at a high rate. In other words, the sensitivity is very high—as represented by the slopes of the lines in the graph. However, at a certain cooling fluid flow rate increases in the rate result in minimal reduction in wheel space temperature. This cooling fluid flow rate is referred to herein as the "flooded flow rate" and is indicated by a dashed vertical flooded flow rate reference line ($FR_{flooded}$) in FIG. 4. The point on the graph that is at the flooded flow rate may be referred to herein as a "flood corner" due to the corner in the line. (In the examples in FIG. 4, both lines (e.g., 24, $L_{2,\ upstream}$, 24, $L_{2,\ downstream}$) have the same flooded flow rate.) Wheel space temperatures positioned to the left of flooded flow rate reference line ($FR_{flooded}$) may substantially change, as the flow rate minimally changes. Conversely, beyond the corner, the wheel space temperature positioned to the right of the flooded flow rate reference line ($FR_{flooded}$) may minimally change as the flow rate of cooling fluid substantially changes.

Based on the illustrated relationship in FIG. 4, a "flooded flow rate" can be defined as a flow rate of cooling fluid above which the wheel space temperature becomes insensitive to increased flow rate. That is, the flooded flow rate is a flow rate of the cooling fluid at which no substantial increase in wheel space cooling can be achieved through increasing of the flow rate. The term "flooded" indicates the concept that the flow of cooling fluid into wheel space 106 of steam turbine component 12 is at a maximum level allowed by the myriad of interacting parameters that determine the allowable amount of cooling fluid flow, e.g., clearance with wheel space 106, working fluid flow therein (e.g., steam), temperature, pressure, etc. The slope of the piecewise linear relationship indicates a "sensitivity" of wheel space temperature to a change in the flow rate, i.e., with X amount of cooling fluid change results in Y change in wheel space temperature. The sensitivity may be labeled "insensitive" where changes in cooling fluid flow rate does not result in substantial changes to wheel space temperature, at a cooling fluid flow rate just above the flooded flow rate.

In operation, cooling system 30 works most efficiently when it delivers a cooling fluid at a "minimum flooded flow rate" $FR_{MFF}$ that just exceeds the flooded flow rate $FR_{flooded}$. In this manner, close-to-maximum wheel space cooling is achieved while delivering as low as possible amount of cooling fluid to achieve that cooling. As discussed herein, by periodically modifying the flow rate of cooling fluid to approximate a minimum flooded flow rate, cooling fluid flow control system 100 may substantially prevent steam turbine component 12 from being negatively affected by the high temperatures of the working fluid during operation. In addition, system 100 minimizes the impact on efficiency created by providing too much cooling fluid. One manner of approximating that minimal flooded flow rate, as will be described herein, is to model the piecewise linear relationship illustrated in FIG. 4 and periodically modify the current flow rate using the model based on whether the sensitivity (slope) is exceeding a sensitivity threshold.

Figure 5:
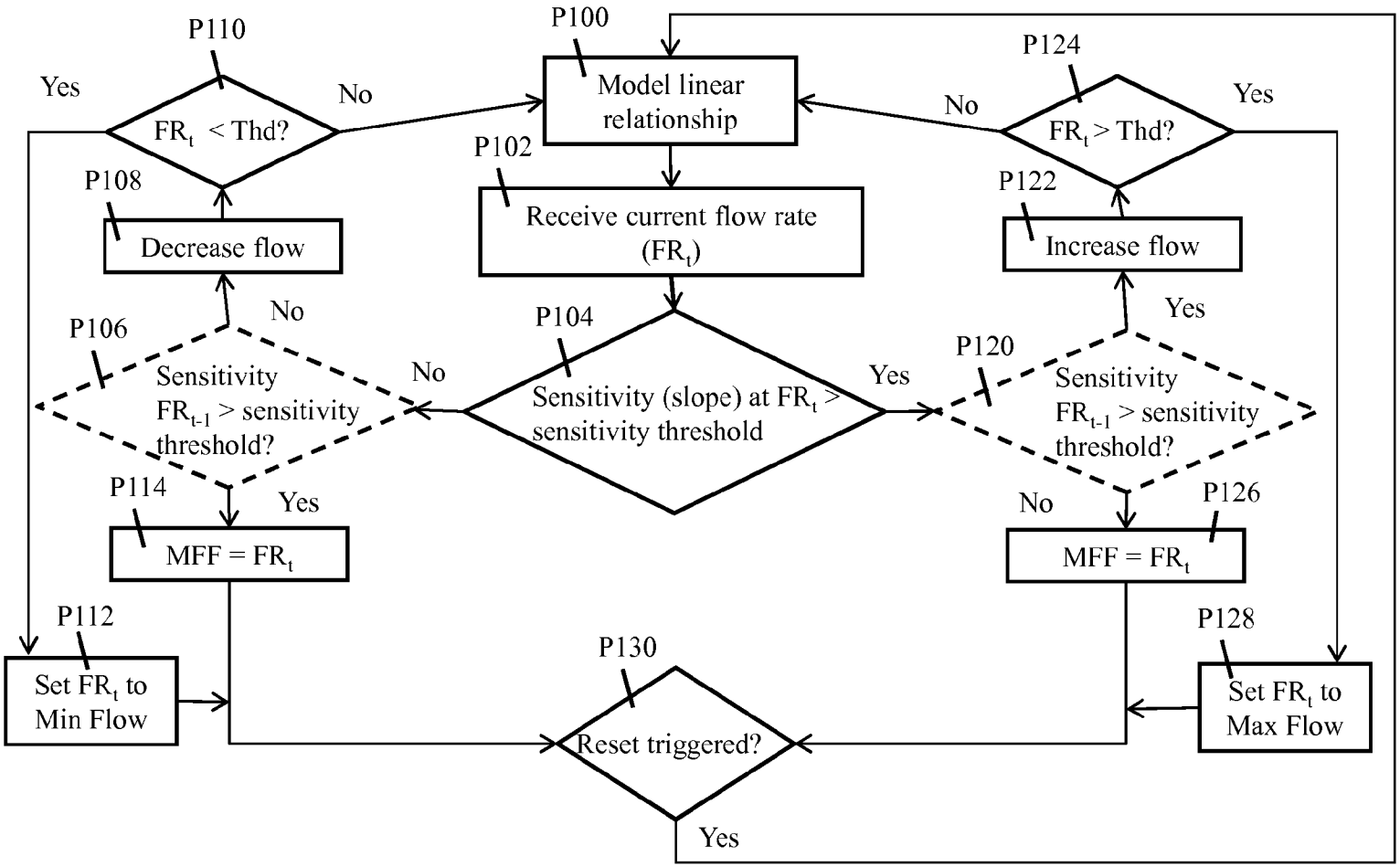
FIG. 5 shows a flow diagram illustrating processes of controlling a flow rate of cooling fluid by a cooling fluid flow control system according to embodiments of the invention.

Turning to FIG. 5, a flow diagram is shown illustrating processes in controlling a flow rate of cooling fluid supplied to turbine section 14 by cooling fluid flow control system 100 according to embodiments of the invention. The process flow diagram in FIG. 5 will be referred to in conjunction with FIGS. 1, 3 and 4.

As shown in FIG. 5, in process P100, control system 100 models a sensitivity of a wheel space temperature to a change in the flow rate in the form of a piecewise linear relationship. That is, control system 100 models wheel space temperature versus a change in flow rate, resulting in the piecewise linear relationship, an example of which is shown in FIG. 4. As shown in FIG. 4, the piecewise linear relationship includes a flooded flow rate above which the wheel space temperature becomes insensitive to increased flow rate. The modeling technique may employ any now known or later developed recursive parameter estimation method. In one embodiment, the modeling may include taking an estimated initial flow rate, an estimated slope (sensitivity), an estimated offset and an estimated lag for the piecewise linear relationship, and estimating an expected wheel space temperature to arrive at the piecewise linear relationship. The modeling may use, for example, a first order linear filter. The initial inputs to the model may be based on a large number of factors for a particular steam turbine system 10 (FIG. 1) and, in particular, a particular turbine system 14 (FIG. 1). The factors may be based on, for example, empirical data or other models.

In terms of initial inputs for the modeling, a particular turbine section 14 may have a somewhat known or estimated sensitivity to changes in cooling fluid flow rate based on empirical data. In this case, an initial estimate of the sensitivity (slope) may be made. Also, estimates may be made of an offset of both wheel space temperature and cooling fluid flow rate, and a lag in wheel space temperature responsiveness to a change in cooling fluid flow in the form of a time constant. The lag value may be based on empirical data for the particular turbine section 14 (FIG. 1). Typically, an initial cooling fluid flow rate is set to a conservative high value above a predicted flooded flow rate and then reduced according to the teachings of the invention. In operation, control system 100, based on a measured wheel space temperature from temperature sensor 104, may determine an error and reiteratively (re)model during operation of turbine section 14, updating the modeling to address any error in the modeling of the sensitivity. The modeling may also be based on at least one of: a load of the steam turbine system and a clearance estimate of the steam turbine system, as both factors impact the piecewise linear relationship. In particular, an increased load shifts the flooded flow rate to a higher value since steam turbine system 10 (FIG. 1), as a whole, is running at higher temperatures. Similarly, an increased wear level over time within turbine section 14 increases the size of wheel space 106 (FIG. 2), requiring increased amount of cooling fluid to cool the same structures.

In process P102, control system 100 receives a measurement of the (current) flow rate (FRt). Flow rate $FR_t$ may be measured by flow meter 110, as described herein. Flow rate $FR_t$ may be that of a single cooling fluid conduit 102 or that of many conduits 102.

In processes P104-P128, control system 100 periodically modifies the flow rate of the cooling fluid supplied to wheel space 106 (FIG. 2) of turbine section 14 (FIG. 1) to approximate a minimum flooded flow rate based on the measured flow rate and the modeling. More specifically, control system 100 may periodically modify the current flow rate $FR_t$, using the model of the piecewise linear relationship, based on whether the sensitivity is exceeding a sensitivity threshold, i.e., a particular slope.

In processes P104-P112, control system 100, in response to the sensitivity repeatedly exceeding the sensitivity threshold, decreases the flow rate until the sensitivity exceeds the sensitivity threshold or until the flow rate reaches a system minimum flow rate. More particularly, in process P104, control system 100, determines whether the sensitivity at the current flow rate $FR_t$, as measured by flow monitor 110 (FIG. 1), is greater than a sensitivity threshold. The sensitivity threshold may be user-defined and selected to indicate the requisite amount of sensitivity (slope) in the piecewise linear relationship indicative of the flow rate being below the flooded flow rate $F_{flooded}$, i.e., left of the flood corner in FIG. 4. For purposes of description, assume a sensitivity threshold of 1.0° C./kg/sec is used, indicating a change of 1 kg/sec in cooling fluid flow rate results in 1° C. change in wheel space temperature. Based on that value, a sensitivity (slope) value higher than 1.0 indicates operation in a non-flooded state, and sensitivity (slope) value lower than 1.0 indicates operation in the flooded state. Consequently, the sensitivity threshold in the form of a slope indicates a point in the piecewise linear relationship between an insensitive relationship and a sensitive relationship by identifying where the flood corner is located.

To illustrate process P104, referring to FIG. 4, an initial cooling fluid flow rate setting ($FR_{init}$) may be set, as described herein, conservatively high to ensure insensitivity of wheel space temperature to cooling fluid flow, i.e., operation beyond the flooded flow rate $FR_{flooded}$. Assume an initial flow rate $FR_{init}$, which then equals a current flow rate $FR_t$, i.e., flow rate at time t. Based on the model, control system 100 determines the sensitivity (slope) at that flow rate $FR_{init}$ from the model. For purposes of description, assume the sensitivity is 0.2° C./kg/sec at that flow rate $FR_{init}$ ($FR_t$). In this case, the sensitivity, based on the model and the current flow rate, is below the sensitivity threshold, i.e., 0.2<1.0, so "NO" at process P104. This result indicates that the current flow rate $FR_t$ (at $FR_{init}$) is not approximating the minimum flooded flow rate $FR_{MFF}$, i.e., it is beyond the flood corner where the slope/sensitivity is very low.

In process P106, control system 100 may repeat the sensitivity exceeding sensitivity threshold determination for a previous time's (t−1) flow rate. That is, control system 100 determines the sensitivity (slope) at that previous flow rate $FR_{t-1}$ from the model (or storage) and determines whether it exceeds the sensitivity threshold. (For an initial flow rate $FR_{init}$, this step may be omitted or an estimate used since there is no previous flow rate). For purposes of description, as shown in FIG. 4, assume the previous flow rate is higher than $FR_{init}$ and is at $FR_C$ and assume the sensitivity is 0.19° C./kg/sec at previous flow rate $FR_{t-1}$, e.g., $FR_{t-1}=FR_C$ on FIG. 4. In this case, the sensitivity based on the model and the current flow rate $FR_{t-1}$, is still below the sensitivity threshold, i.e., 0.19<1.0, so "NO" at process P106. Consequently, at step P108, control system 100 decreases the current cooling fluid flow rate $FR_t$, e.g., by some predetermined increment such as but not limited to 0.3 kg/sec. The decrease occurs because the current flow rate $FR_t$ at $FR_{init}$ and the previous flow rate at $FR_C$ are not, as shown in FIG. 4, approximating a minimum flooded flow rate $FR_{MFF}$. The decrease in the current flow rate moves the flow rate closer to the flood corner and the optimal minimum flooded flow rate $FR_{MFF}$.

After process P108, at process P110, control system 100 determines whether the current flow $FR_t$ (newly decreased) is greater than a system minimum flow rate, indicative of a lowest cooling fluid flow that turbine section 14 (FIG. 1) operates. If "YES" at process P110, control system 100 sets the current flow rate to the system minimum flow rate at process P112. Otherwise, "NO" at process P110, control system 100 processes return to process P100, and the modeling is repeated.

Returning to process P106, assume the sensitivity at previous flow rate $FR_{t-1}$ exceeds the sensitivity threshold. For example, the previous flow rate $FR_{t-1}$ may be less than minimum flooded flow rate $FR_{MFF}$ on FIG. 4, e.g., at flow rate $FR_B$. In this case, process P106 results in a "YES", and at process P114, control system 100 maintains the current flow rate $FR_t$ knowing it is approximating the minimum flooded flow rate $FR_{MFF}$, and no further wheel space temperature reductions are attainable with cooling fluid flow rate decreases.

Returning to process P104, in processes P104, P120-P128, control system 100, in response to the sensitivity repeatedly exceeding a sensitivity threshold, increases the flow rate until the sensitivity is below the sensitivity threshold or until the flow rate reaches a system maximum flow rate. As noted above, in process P104, control system 100, determines whether the sensitivity at the current flow rate $FR_t$, as measured by flow monitor 110 (FIG. 1), is greater than a sensitivity threshold. As also noted above, the sensitivity threshold may be user-defined and selected to indicate the requisite amount of sensitivity (slope) in the piecewise linear relationship indicative of the flow rate being below the flooded flow rate $FR_{flooded}$, i.e., left of the flood corner in FIG. 4. For further purposes of description, continue assuming a sensitivity threshold of 1.0° C./kg/sec is used, indicating a change of 1 kg/sec in cooling fluid flow rate results in 1° C. change in wheel space temperature. Based on that value, a sensitivity higher than 1.0° C./kg/sec indicates operation in a non-flooded state. To illustrate process P104 in the "YES" alternative result, referring to FIG. 4, assume the current flow rate $FR_t$ equals flow rate $FR_B$, which is in a non-flooded region of the graph. Also assume the sensitivity (slope) at that flow rate $FR_B$ is 3.0° C./kg/sec, which is fairly sensitive—a decrease of 1 kg/sec in flow rate results in 3° C. increase in wheel space temperature. In this case, the sensitivity, based on the model and the current flow rate, exceeds the sensitivity threshold, i.e., 3.0>1.0, so "YES" at process P104. This result indicates that the current flow rate $FR_t$ (at $FR_B$) may not be approximating the minimum flooded flow rate $FR_{MFF}$, i.e., it is below the flood corner where the slope/sensitivity is very high.

In process P120, control system 100 may repeat the sensitivity exceeding sensitivity threshold determination for a previous time's (t−1) flow rate. That is, control system 100 determines the sensitivity (slope) at that previous flow rate $FR_{t-1}$ from the model (or storage) and determines whether it exceeds the sensitivity threshold. For purposes of description, as shown in FIG. 4, assume the sensitivity is 4.5° C./kg/sec at previous flow rate $FR_{t-1}$, e.g., $FR_{t-1}=FR_D$ on FIG. 4. In this case, the sensitivity based on the model and the current flow rate $FR_{t-1}$, is still exceeding the sensitivity threshold, i.e., 4.5>1.0, so "YES" at process P120. Consequently, at step P122, control system 100 increases the current cooling fluid flow rate $FR_t$, e.g., by some predetermined increment. The increase occurs because the current flow rate $FR_t$ at $FR_B$ and the previous flow rate at $FR_D$ are not, as shown in FIG. 4, approximating a minimum flooded flow rate $FR_{MFF}$. The increase in the current flow rate moves the flow rate closer to the flood corner and the optimal minimum flooded flow rate $FR_{MFF}$.

After process P120, at process P124, control system 100 determines whether the current flow $FR_t$ (newly increased) is greater than a system maximum flow rate, indicative of a highest cooling fluid flow rate that turbine section (FIG. 1) operates. If "YES" at process P110, control system 100 sets the current flow rate to the system maximum flow rate at process P128. Otherwise, i.e., "NO" at process P124, control system 100 processes return to process P100, and the modeling is repeated.

Returning to process P120, assume the sensitivity at previous flow rate $FR_{t-1}$ does not exceed the sensitivity threshold. For example, the previous flow rate $FR_{t-1}$ may be near the maximum flooded flow rate $FR_{MFF}$ on FIG. 4. In this case, process P120 results in a "NO", and at process P120, control system 100 maintains the current flow rate $FR_t$ knowing it is approximating the minimum flooded flow rate $FR_{MFF}$, and no further wheel space temperature reductions are attainable with cooling fluid flow rate increases.

After processes P112, 114, 126 or 128, at process P130, control system 100 awaits a period that controls when the modifying may occur again, i.e., the period of modifying. In particular, while control system 100 may operate in a fairly continuous fashion, frequent changes may lead to excessive flow valve(s) 108 (FIG. 1) wear or a false perception by an operator that there is no flow control problem. In order to address this situation, periodic modifying and modeling at processes P100-P128 occur only after a reset trigger occurs. In one embodiment, the reset may occur in response to a change in a load of the steam turbine system 10 exceeding a load change threshold, e.g., a 2% load change. Alternatively, the reset may occur in response to passing of a predetermined duration of time, e.g., 4 hours.

With further reference to process P100 and P130, where the reset trigger includes a system load exceeding a load change threshold at process P130, control system 100 will operate between two modeling events. While operating between two modeling events, control system 100 will utilize a $FR_{MFF}$ value extrapolated from the latest available estimation event. In order to avoid providing less flow than what is required to maintain flooded conditions, the extrapolation scheme is carried with an assumed "low" value (e.g., 0.5 kg/sec/% load) in the decreasing load direction and an assumed "high" value (e.g., 2 kg/sec/% load) in the increasing load direction. The reason for this extrapolation is to provide continuous operation while avoiding excessive actuator wear.

Referring to processes P106 and 120, in an alternative embodiment, the repeated determination of whether sensitivity exceeds the sensitivity threshold in processes P106, P120 may be omitted such that a single test at process P104 is all that is carried out prior to increasing or decreasing the current flow rate. In this case, processes P104, P108-112 periodically modify in response to the sensitivity being lower than a sensitivity threshold, decreasing the flow rate until the sensitivity exceeds the threshold or until the flow rate reaches a system minimum flow rate. And, processes P104, P122-128 periodically modify in response to the sensitivity exceeding the slope threshold, increasing the flow rate until the sensitivity exceeds the threshold or until the flow rate reaches a system maximum flow rate.

As discussed herein, operational characteristics of turbine section 14 may vary over time. As a result, the piecewise linear relationship may also change over time with turbine section 14. By continuously performing the process, as discussed herein, control system 100 may provide cooling fluid to turbine section 14 at the desired minimum flooded flow rate, which may prevent creep-effects within the section. Technical effects of the invention, include, but are not limited to modeling a sensitivity of a wheel space temperature to a change in the flow rate in the form of a piecewise linear relationship to identify a flooded flow rate above which the wheel space temperature becomes insensitive to increased flow rate. In addition, periodically modifying the flow rate of the cooling fluid supplied to the wheel space of the turbine section to approximate a minimum flooded flow rate based on the measured flow rate and the modeling acts to reduce the potential damage of high temperature steam in turbine section 14.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system comprising:

at least one computing device operably connected to a cooling system for a turbine section of a steam turbine system for controlling a flow rate of cooling fluid supplied to a wheel space of the turbine section by the cooling system, the at least one computing device performing actions including:

modeling a sensitivity of a wheel space temperature to a change in the flow rate of cooling fluid in the form of a piecewise linear relationship, the piecewise linear relationship including a flooded flow rate above which the wheel space temperature becomes insensitive to increased flow rate of cooling fluid;

receive a measurement of the flow rate of cooling fluid; and periodically modifying the flow rate of cooling fluid supplied to the wheel space of the turbine section, using at least one valve operably connected to the at least one computing device, to approximate a minimum flooded flow rate based on the measured flow rate of cooling fluid and the modeling.

2. The system of claim 1, wherein the modeling is based on at least one of: a load of the steam turbine system and a clearance estimate of the steam turbine system.

3. The system of claim 1, wherein the modeling includes:

making an initial estimate of the sensitivity; and reiterating the modeling during operation of the turbine section, updating the modeling to address any error in the modeling of the sensitivity.

4. The system of claim 1, wherein the periodically modifying occurs in response to a change in a load of the steam turbine system exceeding a load change threshold.

5. The system of claim 4, wherein, in response to the load exceeding the load change threshold, the modeling is repeated, wherein the modeling includes:

increasing the sensitivity in response to the load increasing; and decreasing the sensitivity in response to the load decreasing.

6. The system of claim 1, wherein the periodically modifying occurs in response to passing of a predetermined duration of time.

7. The system of claim 1, wherein the periodically modifying includes:

in response to the sensitivity repeatedly being lower than a sensitivity threshold, decreasing the flow rate of cooling fluid until the sensitivity exceeds the sensitivity threshold or until the flow rate of cooling fluid reaches a system minimum flow rate; and in response to the sensitivity repeatedly exceeding the sensitivity threshold, increasing the flow rate of cooling fluid until the sensitivity is below the sensitivity threshold or until the flow rate of cooling fluid reaches a system maximum flow rate.

8. The system of claim 1, wherein the periodically modifying includes:

in response to the sensitivity being lower than a sensitivity threshold, decreasing the flow rate of cooling fluid until the sensitivity exceeds the sensitivity threshold or until the flow rate of cooling fluid reaches a system minimum flow rate; and in response to the sensitivity exceeding the sensitivity threshold, increasing the flow rate of cooling fluid until the sensitivity below the sensitivity threshold or until the flow rate of cooling fluid reaches a system maximum flow rate.

9. The system of claim 1, wherein the wheel space is that of a high pressure turbine section of an ultra-supercritical steam turbine system.

10. The system of claim 1, further comprising a flow rate monitor positioned to measure the flow rate of cooling fluid and operably connected to the at least one computing device.

11. The system of claim 1, further comprising at least one temperature sensor positioned to measure the wheel space temperature and operably connected to the at least one computing device.

12. A non-transitory computer readable storage medium including a program product for controlling a flow rate of cooling fluid, using at least one valve, supplied to a wheel space of a turbine section of a steam turbine system by a cooling system, the non-transitory computer readable storage medium comprising program code for causing the computer system to:

model a sensitivity of a wheel space temperature to a change in the flow rate of cooling fluid in the form of a piecewise linear relationship, the piecewise linear relationship including a flooded flow rate above which the wheel space temperature becomes insensitive to increased flow rate of cooling fluid;

receive a measurement of the flow rate of cooling fluid; and periodically modify the flow rate of cooling fluid supplied to the wheel space of the turbine section, using the at least one valve, to approximate a minimum flooded flow rate based on the measured flow rate of cooling fluid and the modeling.

13. The non-transitory computer readable storage medium of claim 12, wherein the modeling is based on at least one of: a load of the steam turbine system and a clearance estimate of the steam turbine system.

14. The non-transitory computer readable storage medium of claim 12, wherein the modeling includes:

making an initial estimate of the sensitivity; and reiterating the modeling during operation of the steam turbine, updating the modeling to address any error in the modeling of the sensitivity.

15. The non-transitory computer readable storage medium of claim 12, wherein the periodically modifying occurs in response to a change in a load of the steam turbine system exceeding a load change threshold.

16. The non-transitory computer readable storage medium of claim 15, wherein, in response to the load exceeding the load change threshold, the modeling is repeated, wherein the modeling includes:

increasing the sensitivity in response to the load increasing; and decreasing the sensitivity in response to the load decreasing.

17. The non-transitory computer readable storage medium of claim 12, wherein the periodically modifying includes:

in response to the sensitivity repeatedly being lower than a sensitivity threshold, decreasing the flow rate of cooling fluid until the sensitivity exceeds the sensitivity threshold or until the flow rate of cooling fluid reaches a system minimum flow rate; and in response to the sensitivity repeatedly exceeding the sensitivity threshold, increasing the flow rate of cooling fluid until the sensitivity is below the sensitivity threshold or until the flow rate of cooling fluid reaches a system maximum flow rate.

18. The non-transitory computer readable storage medium of claim 12, wherein the periodically modifying includes:

in response to the sensitivity being lower than a slope threshold, decreasing the flow rate of cooling fluid until the sensitivity exceeds the threshold or until the flow rate of cooling fluid reaches a system minimum flow rate; and in response to the sensitivity exceeding the slope threshold, increasing the flow rate of cooling fluid until the sensitivity is below the threshold or until the flow rate of cooling fluid reaches a system maximum flow rate.

19. A steam turbine system cooling system comprising:

at least one flow valve for controlling a cooling fluid flow to a wheel space of a turbine section from a source of cooling fluid; and at least one computing device operably connected to the at least one flow valve for controlling the flow rate of cooling fluid supplied to the wheel space, the at least one computing device performing actions including:

modeling a sensitivity of a wheel space temperature to a change in the flow rate of cooling fluid in the form of a piecewise linear relationship, the piecewise linear relationship including a flooded flow rate above which the wheel space temperature becomes insensitive to increased flow rate of cooling fluid;

receiving a measurement of the flow rate of cooling fluid; and periodically modifying the flow rate of cooling fluid supplied to the wheel space of the turbine section to approximate a minimum flooded flow rate based on the measured flow rate of cooling fluid and the modeling.

* * * * *